US011315705B2

(12) United States Patent
Lee et al.

(10) Patent No.: US 11,315,705 B2
(45) Date of Patent: Apr. 26, 2022

(54) CABLE WITH INSULATING PART AND METHOD OF PRODUCING CABLE INSULATING PART

(71) Applicant: SKC Co., Ltd., Suwon-si (KR)

(72) Inventors: Sechul Lee, Bucheon-si (KR); Young Min Heo, Suwon-si (KR); Jung Hee Ki, Suwon-si (KR); Sang Min Choi, Suwon-si (KR)

(73) Assignee: SKC Co., Ltd, Suwon-si (KR)

( * ) Notice: Subject to any disclaimer, the term of this patent is extended or adjusted under 35 U.S.C. 154(b) by 0 days.

(21) Appl. No.: 16/401,292

(22) Filed: May 2, 2019

(65) Prior Publication Data

US 2020/0075194 A1 Mar. 5, 2020

(30) Foreign Application Priority Data

Sep. 4, 2018 (KR) ..... 10-2018-0105596

(51) Int. Cl.

| | |
|---|---|
| ***H01B 3/42*** | (2006.01) |
| ***H01B 7/08*** | (2006.01) |
| ***H01B 13/06*** | (2006.01) |
| ***H01B 19/00*** | (2006.01) |

(52) U.S. Cl.

CPC ..... *H01B 3/421* (2013.01); *H01B 7/0823* (2013.01); *H01B 7/0838* (2013.01); *H01B 13/06* (2013.01); *H01B 19/00* (2013.01)

(58) Field of Classification Search

CPC ..... H01B 13/06; H01B 19/00; H01B 3/421; H01B 3/422; H01B 3/423; H01B 7/0823; H01B 7/0838

See application file for complete search history.

(56) References Cited

U.S. PATENT DOCUMENTS

| | | | | |
|---|---|---|---|---|
| 4,897,301 A * | 1/1990 | Uno | H05K 1/0326 | 174/254 |
| 5,439,626 A * | 8/1995 | Bennett | D01D 5/24 | 264/103 |
| 5,833,905 A * | 11/1998 | Miki | B29C 48/9165 | 264/211.21 |
| 5,895,703 A * | 4/1999 | Kurihara | B29C 53/32 | 428/188 |
| 6,303,210 B1 * | 10/2001 | Watanabe | B41M 5/41 | 428/141 |
| 6,433,071 B1 * | 8/2002 | Arai | C08L 81/06 | 257/E23.005 |
| 6,646,060 B1 * | 11/2003 | Toyohara | C08G 73/1082 | 525/425 |

(Continued)

FOREIGN PATENT DOCUMENTS

| | | |
|---|---|---|
| CN | 102615893 A | 8/2012 |
| CN | 104204091 A | 12/2014 |

(Continued)

*Primary Examiner* — William H. Mayo, III
*Assistant Examiner* — Rhadames Alonzo Miller
(74) *Attorney, Agent, or Firm* — NSIP Law

(57) ABSTRACT

A cable includes an insulating part and one or more conducting parts disposed inside the insulating part. The insulating part includes a polymer resin layer with a product of shrinkage ratios $C_{MD*TD}$, which is expressed as a product of a longitudinal shrinkage ratio and a transverse shrinkage ratio, of less than 0.24.

9 Claims, 2 Drawing Sheets

(56) References Cited

U.S. PATENT DOCUMENTS 10,147,516 B2 12/2018 Yamada et al.
2003/0001139 A1* 1/2003 Nagano ..... C08K 3/01 252/299.67
2003/0024729 A1* 2/2003 Suzuki ..... H01B 3/441 174/117 FF
2006/0025561 A1* 2/2006 Watanabe ..... C08K 7/14 528/272
2006/0078824 A1* 4/2006 Chiba ..... G03F 7/11 430/270.1
2006/0269764 A1* 11/2006 Tanaka ..... B32B 27/36 428/458
2008/0167406 A1* 7/2008 Yamada ..... C08L 67/02 524/116
2009/0126970 A1* 5/2009 Sasaki ..... H01P 3/00 174/110 SR
2009/0215933 A1* 8/2009 Kasai ..... C08G 63/85 524/115
2009/0297752 A1* 12/2009 Togawa ..... C08G 63/6926 428/36.92
2010/0062239 A1* 3/2010 Yoshida ..... B32B 27/18 428/323
2010/0101824 A1* 4/2010 Fujimoto ..... H01B 3/423 174/110 SR
2011/0284075 A1* 11/2011 Hatakeyama ..... H01L 31/049 136/259
2012/0080089 A1* 4/2012 Aoyama ..... B32B 9/00 136/256
2012/0177854 A1* 7/2012 Lee ..... G06F 8/65 428/35.7
2012/0196112 A1* 8/2012 Kliesch ..... C08J 5/18 428/220
2012/0196979 A1* 8/2012 Kliesch ..... B29C 48/914 524/605
2012/0226014 A1* 9/2012 Lee ..... C08J 5/18 528/298
2012/0244365 A1* 9/2012 Chen ..... C08L 75/04 428/457
2015/0051324 A1* 2/2015 Nonokawa ..... C08K 5/29 524/89
2015/0124415 A1* 5/2015 Goyal ..... H05K 1/18 361/749
2016/0194466 A1* 7/2016 Nakamura ..... B32B 27/06 174/254
2017/0148544 A1 5/2017 Yamada et al.
2018/0044507 A1* 2/2018 Yoshida ..... C08J 3/203
2018/0079877 A1* 3/2018 Ishimaru ..... C08J 5/18
2019/0096548 A1* 3/2019 Yoshida ..... B32B 27/304
2019/0384027 A1* 12/2019 Hoshino ..... G02B 6/4429

FOREIGN PATENT DOCUMENTS

CN 107880802 A 4/2018
CN 107995891 A 5/2018
EP 2 482 334 A2 8/2012
EP 2 482 337 A2 8/2012
JP 2014-88541 A 5/2014
KR 10-2009-0106341 A 10/2009
KR 10-1094233 B1 12/2011
KR 10-2012-0099184 A 9/2012
WO WO 2013/146625 A1 10/2013
WO WO 2016/023818 A1 2/2016

* cited by examiner

CABLE WITH INSULATING PART AND METHOD OF PRODUCING CABLE INSULATING PART

CROSS-REFERENCE TO RELATED APPLICATION

This application claims the benefit under 35 USC 119(a) of Korean Patent Application No. 10-2018-0105596, filed on Sep. 4, 2018, in the Korean Intellectual Property Office, the entire disclosure of which is incorporated herein by reference for all purposes.

BACKGROUND

1. Field

This application relates to a cable including an insulating part that improves both heat resistance and moisture resistance, and a method of producing a cable insulating part.

2. Discussion of the Background

An electric wire, which is called an insulated wire, a cable, or the like, is widely used for transmitting power or communication signals and includes a structure for covering a conductor such as copper or aluminum with an insulator.

A flexible flat cable (FFC) is mainly used as a relay cable for various components placed inside an electronic device. An FFC has excellent flexibility and thus can be used for a moving part as well as a fixed part. Also, an FFC is used in a wide range of fields because it has a lower production cost than a flexible print circuit board (FPCB). An FFC is applied in the form of arranging a plurality of conducting wires between insulating films by means of adhesive.

Polyethylene terephthalate (PET), polyethylene naphthalene-2,6-dicarboxylate (PEN), polybutylene terephthalate (PBT), polyimide (PI), or the like is used as an insulating layer of an FFC, but these polymers have problems such as insufficient heat resistance, high unit cost, poor moisture resistance, or the like.

The above information is presented as background information only to assist with an understanding of the present disclosure. No determination has been made, and no assertion is made, as to whether any of the above might be applicable as prior art with regard to the disclosure.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, a cable includes an insulating part, and one or more conducting parts disposed inside the insulating part, wherein the insulating part includes a polymer resin layer with a product of shrinkage ratios $C_{MD*TD}$ of less than 0.24, as expressed in Equation 1 below:

$$C_{MD*TD}=C_{MD}\times C_{TD}, \quad \text{[Equation 1]}$$

where $C_{MD*TD}$ is a product of shrinkage ratios, $C_{MD}$ is a longitudinal shrinkage ratio (%), and $C_{TD}$ is a lateral shrinkage ratio (%).

The polymer resin layer may include diol-based repeating units.

The diol-based repeating units may include 85 mol % or greater diol-based repeating units each having a cyclohexane skeleton with respect to all the diol-based repeating units.

A smaller one of the longitudinal shrinkage ratio and the lateral shrinkage ratio of the polymer resin layer may be less than or equal to 0.3%.

A larger one of the longitudinal shrinkage ratio and the lateral shrinkage ratio of the polymer resin layer may be less than or equal to 1.2%.

The insulating part may be a polyester layer containing diol-based repeating units and dicarboxylic acid-based repeating units.

The dicarboxylic acid-based repeating units may include about 1 mol % to about 30 mol % isophthalic acid-based repeating units with respect to all the dicarboxylic acid-based repeating units.

The polymer resin layer may have an intrinsic viscosity of 0.55 dl/g or greater after a pressure cooker test at 121° C. and 100 RH % for 96 hours.

The cable may be a flexible flat cable.

In another general aspect, a cable includes an insulating part and one or more conducting parts disposed inside the insulating part, wherein the insulating part includes a polymer resin layer with an intrinsic viscosity retention ratio $D_{iv}$ of 70% or greater, as expressed in Equation 2 below:

$$D_{iv}=100\times(IV_2/IV_1), \quad \text{[Equation 2]}$$

where $D_{iv}$ is an intrinsic viscosity retention ratio, $IV_1$ is an intrinsic viscosity (dl/g) of the polymer resin layer before a pressure cooker test at 121° C. and 100 RH % for 96 hours, and $IV_2$ is an intrinsic viscosity (dl/g) of the polymer resin layer after the pressure cooker test.

The polymer resin layer may include an intrinsic viscosity retention ratio $D_{iv}$ of about 75% to about 85%.

In another general aspect, there is provided a method of producing a cable insulating part, the method including polymerizing a composition including i) dicarboxylic acid-based compounds and ii) diol-based compounds including cyclohexanediol-based compounds 85 mol % or greater to form a resin melt, extruding the polymer resin melt to form an unstretched film, biaxially stretching the unstretched film in longitudinal and transverse directions to produce a stretched film, and heat setting the stretched film at a heat setting temperature of about 230° C. to about 265° C. to produce an insulating polymer resin layer, wherein the insulating part including the polymer resin layer has a product of shrinkage ratios $C_{MD*TD}$ of less than 0.24, as expressed in Equation 1.

The method may further include disposing a conducting part on the insulating polymer resin layer.

The method may further include disposing an adhesive layer between the conducting part and the insulating polymer resin layer.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

Figure 1:
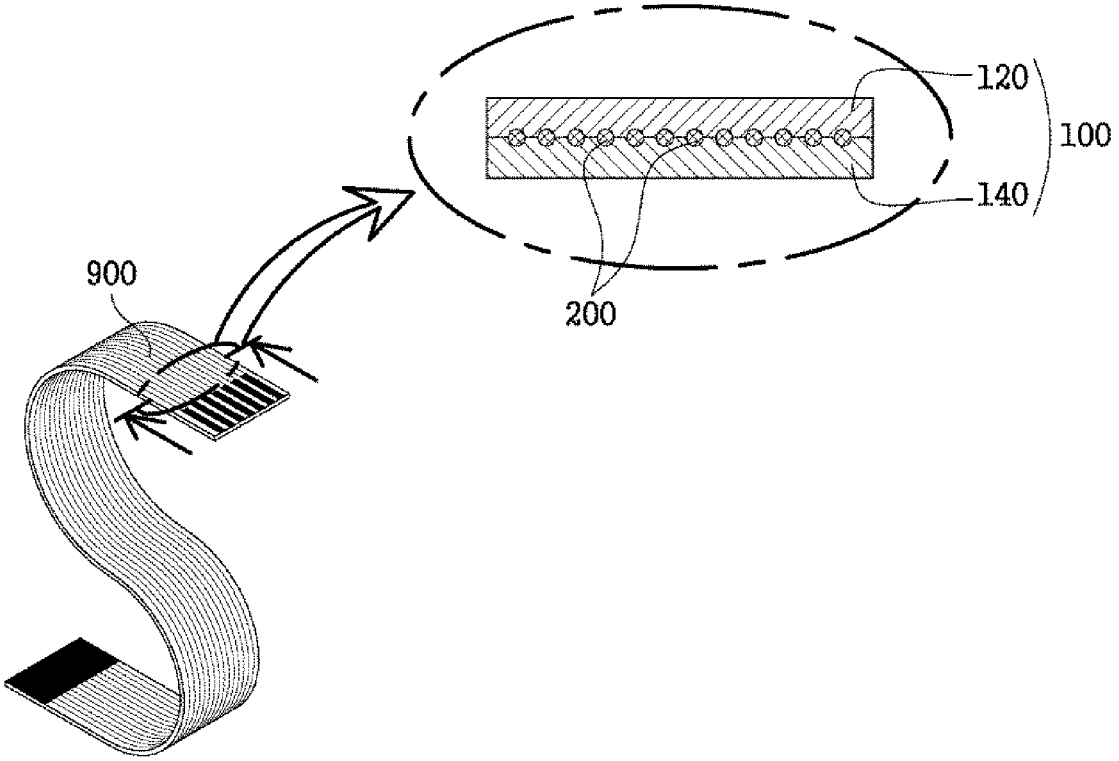
FIG. 1 is a conceptual view illustrating a flexible flat cable, which is an example cable, in the one or more examples described herein.

The following detailed description is provided to assist the reader in gaining a comprehensive understanding of the methods, apparatuses, and/or systems described herein. However, various changes, modifications, and equivalents of the methods, apparatuses, and/or systems described herein will be apparent after gaining an understanding of the disclosure of this application. For example, the sequences of operations described herein are merely examples, and are not limited to those set forth herein, but may be changed, as will be apparent after gaining an understanding of the disclosure of this application, with the exception of operations necessarily occurring in a certain order. Also, descriptions of features that are known in the art may be omitted for increased clarity and conciseness.

The features described herein may be embodied in different forms, and are not to be construed as being limited to the examples described herein. Rather, the examples described herein have merely been provided to illustrate some of the many possible ways of implementing the methods, apparatuses, and/or systems described herein that will be apparent after an understanding of the disclosure of this application.

Throughout the specification, when an element, such as a layer, region, or substrate, is described as being "on," "connected to," or "coupled to" another element, it may be directly "on," "connected to," or "coupled to" the other element, or there may be one or more other elements intervening therebetween. In contrast, when an element is described as being "directly on," "directly connected to," or "directly coupled to" another element, there can be no other elements intervening therebetween.

The terminology used herein is for describing various examples only, and is not to be used to limit the disclosure. As used herein, the term "and/or" includes any one and any combination of any two or more of the associated listed items; likewise, "at least one of" includes any one and any combination of any two or more of the associated listed items. The terms "comprises," "includes," and "has" specify the presence of stated features, numbers, operations, members, elements, and/or combinations thereof, but do not preclude the presence or addition of one or more other features, numbers, operations, members, elements, and/or combinations thereof.

Throughout the present specification, the phrase "combination(s) thereof" included in a Markush-type expression denotes one or more mixtures or a combination selected from the group consisting of components stated in the Markush-type expression, that is, denotes that one or more components selected from the group consisting of the components are included.

Throughout this specification, terms such as "first," "second," "A," or "B" are used to distinguish the same terms from each other. Also, the singular forms "a," "an," and "the" are intended to include the plural forms as well, unless the context clearly indicates otherwise.

In this specification, the term "X-based" may mean that a compound includes a compound corresponding to X or a derivative of X. The term "derivative" means a compound that is derived from a specific compound as a mother compound by functional group introduction, oxidation, reduction, atom substitution, or the like, to the extent that the structure and properties of the mother compound do not change.

In this specification, B being placed on A means that B is placed in direct contact with A or placed over A with another layer interposed therebetween and thus should not be interpreted as being limited to B being placed in direct contact with A.

In this specification, a singular form is contextually interpreted as including a plural form as well as a singular form unless specially stated otherwise.

In this specification, the phrase "X-based repeating unit" means a repeating unit that is derived from an X-based compound obtained through polymerization in which a polymer is generated by using the X-based compound as a monomer.

In this specification, the phrase "difference between A and B" means an absolute value unless specially stated otherwise. That is, even when B is smaller than A, B minus A has the same difference as A minus B.

Due to manufacturing techniques and/or tolerances, variations of the shapes shown in the drawings may occur. Thus, the examples described herein are not limited to the specific shapes shown in the drawings, but include changes in shape that occur during manufacturing.

The use of the term "may" with respect to an example or embodiment, for example, as to what an example or embodiment may include or implement, means that at least one example or embodiment exists in which such a feature is included or implemented while all examples and embodiments are not limited thereto.

The features of the examples described herein may be combined in various ways as will be apparent after an understanding of the disclosure of this application. Further, although the examples described herein have a variety of configurations, other configurations are possible as will be apparent after an understanding of the disclosure of this application.

In this specification, a cable refers to an insulated wire as well as a general cable.

Aspects of this disclosure are directed to providing a cable including an insulating part that improves both heat resistance and moisture resistance, a method of producing a cable insulating part.

Figure 2A:
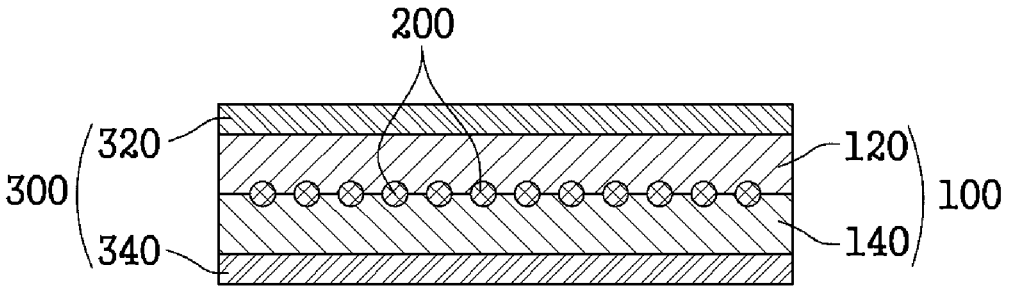
FIGS. 2A and 2B are conceptual views illustrating sectional views of flexible flat cables, which are example cables, in the one or more examples described herein.
Figure 2B:
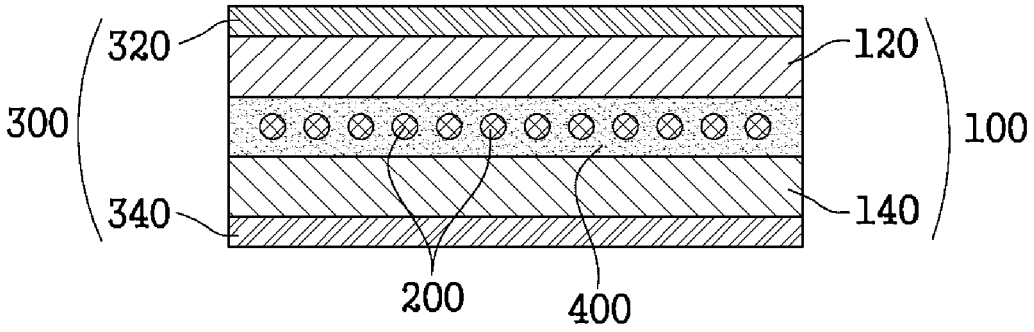

FIG. 1 is a conceptual view illustrating a flexible flat cable, which is an example cable, in the one or more examples described herein, and FIGS. 2A and 2B are conceptual views illustrating sectional views of flexible flat cables, which are example cables, in the one or more examples described herein.

A cable 900 according to an example includes an insulating part 100 and at least one conducting part 200 disposed inside the insulating part 100.

An electrically conductive material, such as a copper wire, a silver wire, an aluminum wire, and an electrically conductive paste, may be used without any restriction on its type or form as long as the material can function as a wire.

By surrounding the conducting part 200 disposed therein, the insulating part 100 provides insulating properties to parts other than the conducting part 200 of the cable 900. Generally, the insulating part 100 may be formed to surround the conducting part 200 by combining a first resin layer 120 and a second resin layer 140 of the insulating part 100 while facing each other (See FIG. 2A). Also, the insulating part 100 may be included in the cable 900 along with an adhesive layer 400 (an insulating adhesive layer) that surrounds the conducting part 200 and joins the first resin layer 120 and the second resin layer 140 (See FIG. 2B). The adhesive layer 400 may be formed by applying an adhesive resin, and two or more separate adhesive layers may be adhered to each other with the conducting part 200 interposed therebetween.

In the insulating part 100 having the form as shown in FIG. 2A, when the first resin layer 120 and the second resin layer 140 are formed of the same material, it may be difficult to find a boundary therebetween.

The insulating part 100 may be in the form of a film, and hereinafter is used interchangeably with an insulating layer 100.

The insulating part 100 should be less likely to change in external appearance or physical properties even if it is exposed to heat or moisture in a miniaturized electronic device product for a long time. The insulating part 100 of the examples described herein includes a polymer resin layer with an excellent heat resistance and a product of shrinkage ratios $C_{MD*TD}$ of less than 0.24, as expressed in Equation 1 below:

$$C_{MD*TD}=C_{MD}\times C_{TD}, \quad \text{[Equation 1]}$$

where $C_{MD*TD}$ is a product of shrinkage ratios, $C_{MD}$ is a longitudinal shrinkage ratio (%), and $C_{TD}$ is a lateral shrinkage ratio (%).

The shrinkage ratios are values obtained by evaluating a result of measuring the lateral length and longitudinal length of a sample of an insulating part, which has a lateral length of 20 cm and a longitudinal length of 1 cm, after the sample is heated in an oven at 150° C. for 30 minutes, as expressed as Equation 3 below:

$$\text{Shrinkage Ratio (\%)}=[(L_0-L)/L_0]\times 100, \quad \text{[Equation 3]}$$

where $L_0$ is a longitudinal length or lateral length (cm) before the heat treatment and L is a longitudinal length or lateral length (cm) after the heat treatment.

The larger one of the longitudinal shrinkage ratio and the lateral shrinkage ratio of the polymer resin layer may be less than or equal to 1.2%, for example, less than or equal to 1.1%, for example, from about 0.1% to about 1.1%.

The smaller one of the longitudinal shrinkage ratio and the lateral shrinkage ratio of the polymer resin layer may be less than or equal to 0.3%, for example, less than or equal to 0.25%, for example, from about 0.01% to about 0.25%.

The product of shrinkage ratios ($C_{MD*TD}$) of the polymer resin layer may be less than or equal to 0.23, for example, less than or equal to 0.22, for example, less than or equal to 0.21, and even, for example, from about 0.001 to about 0.21.

These characteristics mean that the insulating part 100 has an excellent heat resistance.

The polymer resin layer includes 85 mol % or greater diol-based repeating units each having a cyclohexane skeleton.

For example, each diol-based repeating unit including the cyclohexane skeleton may be a repeating unit that is derived from a diol-based compound selected from the group consisting of 1,2-cyclohexanediol, 1,3-cyclohexanediol, 1,4-cyclohexanediol, and combinations thereof.

For example, each diol-based repeating unit including the cyclohexane skeleton may be a repeating unit that is derived from a cyclohexanediol-based compound. When the polymer resin layer includes the cyclohexanediol-based repeating units, the polymer resin layer can have a higher glass transition temperature and an excellent heat resistance.

For example, the polymer resin layer may include about 85 mol % to about 100 mol % diol-based repeating units each including the cyclohexane skeleton with respect to all the diol-based repeating units included in the polymer resin layer, for example, about 90 mol % to 100 mol %, for example, about 95 mol % to 100 mol %, and even, for example, about 98 mol % to 100 mol %. When the above mole percentage of diol-based repeating units each including the cyclohexane skeleton with respect to all the diol-based repeating units are applied to the polymer resin layer, the polymer resin layer can have an excellent heat resistance and an enhanced moisture resistance.

Each diol-based repeating unit including the cyclohexane skeleton may be composed of a repeating unit that is derived from 1,4-cyclohexanediol (1,4-cyclohexanedimethanol (CHDM)).

The polymer resin layer may be a polyester layer including a diol-based repeating unit and a dicarboxylic acid-based repeating unit.

The diol-based repeating unit includes the diol-based repeating unit including the cyclohexane skeleton, as described above.

When the diol-based repeating unit further includes a diol-based repeating unit other than the diol-based repeating unit including the cyclohexane skeleton, the diol-based repeating unit may be derived from any one diol-based compound selected from the group consisting of ethylene glycol, spiroglycol, 1,3-propanediol, 1,2-octanediol, 1,3-octanediol, 2,3-butanediol, 1,3-butanediol, 1,4-butanediol, 1,5-pentanediol, 2,2-dimethyl-1,3-propanediol, 2-butyl-2-ethyl-1,3-propanediol, 2,2-diethyl-1,5-pentanediol, 2,4-diethyl-1,5-pentanediol, 3-methyl-1,5-pentanediol, 1,1-dimethyl-1,5-pentanediol, diethylene glycol, neopentyl glycol, cyclohexanedimethanol, and combinations thereof.

The dicarboxylic acid-based repeating units may include about 1 mol % to about 30 mol % isophthalic acid-based repeating units with respect to all the dicarboxylic acid-based repeating units. For example, the dicarboxylic acid-based repeating units may include about 3 mol % to about 25 mol % isophthalic acid-based repeating units with respect to all the dicarboxylic acid-based repeating units, for example, about 5 mol % to about 20 mol %. Each isophthalic acid-based repeating unit is a repeating unit that is derived from an isophthalic acid-based compound, that is, a repeating unit obtained by using an isophthalic acid-based compound as a monomer.

When the above mole percentage of the isophthalic acid-based repeating units are included in the dicarboxylic acid-based repeating units, it is possible to help lower a crystallization rate of a polyester resin, which includes the diol-based repeating units and thus has high heat resistance but also high crystallinity, while maintaining the heat resistance above a certain level.

Also, the dicarboxylic acid-based repeating unit may further include a dicarboxylic acid-based repeating unit other than the above-described isophthalic acid-based repeating unit. For example, the dicarboxylic acid-based repeating unit may include a repeating unit that is derived from any one selected from the group consisting of terephthalic acid, dimethyl terephthalate, isophthalic acid, naphthalene dicarboxylic acid, orthophthalic acid, cyclohexanedicarboxylic acid, adipic acid, azelaic acid, sebacic acid, decanedicarboxylic acid, esters thereof, and combinations thereof.

The dicarboxylic acid-based repeating unit may include a repeating unit that is derived from any one selected from the group consisting of, for example, terephthalic acid, isophthalic acid, naphthalene dicarboxylic acid, cyclohexanedicarboxylic acid, and combination thereof.

The dicarboxylic acid-based repeating units may include about 70 mol % to about 99 mol % terephthalic acid-based repeating units with respect to all the dicarboxylic acid-based repeating units, for example, about 75 mol % to about 97 mol %, for example, about 80 mol % to about 95 mol %.

The polymer resin layer may be a polyester resin layer with a glass transition temperature of about 87° C. to about 95° C.

The polymer resin layer may have an intrinsic viscosity $IV_1$ greater than or equal to 0.50 dl/g and less than or equal to 0.80 dl/g. The intrinsic viscosity $IV_1$ of the polymer resin layer may be greater than or equal to 0.65 dl/g and less than or equal to 0.75 dl/g.

The polymer resin layer after a pressure cooker test at 121° C. and 100 RH % for 96 hours may have an intrinsic viscosity $IV_2$ greater than or equal to 0.55 dl/g, for example, greater than or equal to 0.60 dl/g and less than or equal to 0.80 dl/g. For example, the polymer resin layer may be a polyester with an intrinsic viscosity $IV_2$ of about 0.58 to about 0.62 dl/g after a pressure cooker test at 121° C. and 100 RH % for 96 hours. These intrinsic viscosity characteristics mean that the polymer resin layer is strongly resistant to hydrolysis, and the intrinsic viscosity is a fairly good value compared to those of general polyester resins.

The polymer resin layer may have an intrinsic viscosity retention ratio $D_{iv}$ of 70% or greater, as expressed using Equation 2 below:

$$D_{iv}=100\times(IV_2/IV_1), \quad \text{[Equation 2]}$$

where $D_{iv}$ is an intrinsic viscosity retention ratio, $IV_1$ is an intrinsic viscosity of the polymer resin layer before a pressure cooker test at 121° C. and 100 RH % for 96 hours, and $IV_2$ is an intrinsic viscosity of the polymer resin layer after the pressure cooker test.

The intrinsic viscosity retention ratio $D_{iv}$ of the polymer resin layer may be greater than or equal to 70%, for example, about 75% to about 85%. The intrinsic viscosity retention ratio is relatively high, and this means that the polymer resin layer included in a heat resistance layer of the present invention has an excellent heat resistance and moisture resistance because hydrolysis does not occur easily under high temperature and high humidity conditions.

The polymer resin layer may be a biaxial-stretched polyester layer and may be a layer that is obtained by combining two biaxial-stretched polyester layers with each other with the conducting part 200 interposed therebetween.

The polymer resin layer may include either or both of the first resin layer 120 and the second resin layer 140.

The first resin layer 120 and the second resin layer 140 may each have a thickness of about 1 μm to about 150 μm, for example, about 1 μm to about 100 μm, for example, about 1 μm to about 50 μm. The polymer resin layer may have a thickness of about 10 μm to about 300 μm, for example, about 10 μm to about 100 μm, for example, about 10 μm to about 80 μm. The first resin layer 120, the second resin layer 140, and the polymer resin layer may have excellent insulation characteristics even at a relatively small thickness and may provide the insulating part 100 having excellent heat resistance and moisture resistance.

The conducting part 200 may be included in the cable 900 in direct contact with the polymer resin layer included in the insulating part 100 and may be included in the form of being adhered by the adhesive layer 400 placed between the polymer resin layer and the conducting part 200. For example, an insulating adhesive layer is used as the adhesive layer 400. Any adhesive layer may be used without limitations as long as the adhesive layer can be utilized for a wire, a cable, and the like.

The cable 900 may further include a cover part 300 surrounding the above-described insulating part 100. For example, a first cover layer 320 and a second cover layer 340 may be included in one surface and the other surface which are opposite to the conducting part 200 of the insulating part 100.

The cover part 300 may be formed as a coating layer with a thickness of about 70 μm or less, and any coating layer may be used without limitations as long as the coating layer can be used as the cover layer (coating layer) of the cable 900.

The cable 900 in the examples described herein includes an insulating part including the above-described polymer resin layer and may form the insulating part 100 having excellent heat resistance and moisture resistance while polyester-based resins are used instead of expensive polyimide resins.

In the examples described herein, the cable 900 may be a flexible flat cable.

In order to achieve the object, the cable 900 according to the examples described herein may include an insulating part 100 and one or more conducting parts 200 disposed inside the insulating part 100, and the insulating part 100 may include a polymer resin layer with an intrinsic viscosity retention ratio $D_{iv}$ of 70% or greater, as expressed using Equation 2 below:

$$D_{iv}=100\times(IV_2/IV_1) \quad \text{[Equation 2]}$$

where $D_{iv}$ is an intrinsic viscosity retention ratio, $IV_1$ is an intrinsic viscosity (dl/g) of the polymer resin layer before a pressure cooker test at 121° C. and 100 RH % for 96 hours, and $IV_2$ is an intrinsic viscosity (dl/g) of the polymer resin layer after the pressure cooker test.

A further detailed description of the polymer resin layer may be omitted because it overlaps with the above description.

A method of producing a cable insulating part according to one or more examples described herein includes a preparation step, a molding step, a stretching step, and a heat setting step, and is used to produce an insulating part including a polymer resin layer with a product of shrinkage ratios $C_{MD*TD}$, which is expressed using the above Equation 1, of less than 0.24 and/or a polymer resin layer with an intrinsic viscosity retention ratio $D_{iv}$, which is expressed using the above Equation 2, of 70% or greater.

In the preparation step, an insulating polymer resin melt is produced by polymerizing an insulating part-specific composition including i) dicarboxylic acid-based compounds and ii) diol-based compounds including cyclohexanediol-based compounds 85 mol % or greater.

Further detailed descriptions of the dicarboxylic acid-based compound, the cyclohexanediol-based compound, and the diol-based compound, and their contents may be omitted because they overlap with that of the polymer resin layer.

The insulating part-specific composition may be obtained by using the above-mentioned dicarboxylic acid-based compound or diol-based compound as a monomer. In addition, if necessary, the insulating part-specific composition may further include additives such as plasticizers, fillers, lubricants, light stabilizers, pigments, dyes, antibacterial agents, processing aids, antiblocking agents, UV absorbers, flame retardants, and the like.

The molding step is a step of extruding the polymer resin melt to mold an unstretched film. An extruder may be applied to the extrusion, and any method may be applied without limitations as long as the method is a method of melt-extruding a conventional polymer resin to form a film or sheet.

The stretching step is a step of biaxially stretching the unstretched film in longitudinal and transverse directions to produce a stretched film.

Through the biaxial stretching, an unstretched film is stretched in two directions, that is, a first direction and a second direction. The first direction is a longitudinal direction LD, that is, a mechanical direction MD. The second direction is a transverse direction TD, that is, a tenter direction TD.

A longitudinal stretching ratio may be about 2 to 4, for example, about 2.5 to 3.5, for example, about 2.7 to 3.0. A transverse stretching ratio may be about 2.5 to 4.5, for example, about 3 to 4.2, for example, about 3.2 to 4.2.

A product of the longitudinal and transverse stretching ratios MD×TD may be about 8 to 16, for example, about 9 to 14, for example, about 10 to 12.

The stretching ratios, the product of stretching ratios, and the like of the insulating part are relatively low compared to those of a polyester film used for other purposes such as optics and are values considering characteristics, such as mechanical strength, of the insulating part of the examples described herein.

A longitudinal stretching rate may be about 22 m/min to about 500 m/min, for example, about 25 m/min to about 400 m/min, for example, about 25 m/min to about 200 m/min. The longitudinal stretching rate being greater than or equal to 22 m/min is advantageous in maintaining desired orientation in the present invention. Since crystallinity is imparted depending on the longitudinal stretching rate and stretching ratios, a transverse stretching rate may vary depending on the longitudinal stretching conditions.

The heat setting step is a step of heat-setting the stretched film at a heat setting temperature of about 230° C. to about 265° C. to produce an insulating polymer resin layer. When the heat setting is performed below about 230° C., the shrinkage ratio of the film may be increased. When the heat setting is performed above about 265° C., the film is liable to be crystallized, such that mechanical properties may be lowered and production in film form may be difficult.

The heat setting temperature may be about 235° C. to about 263° C., for example, about 238° C. to about 260° C. When the heat setting is performed at such a temperature, it is possible to impart orientation to a polymer chain and to minimize damage to a polymer chain due to hydrolysis.

A method of producing a cable according to still one or more other examples described herein includes a placing step in which a cable laminate is formed by preparing two polymer resin layers, each of which is the above-described cable insulating part, and placing one or more conducting parts between the two polymer resin layers; and a producing step in which a cable is produced by pressing the cable laminate.

The placing step may further include placing an adhesive layer between the conducting part and the polymer resin layers or applying an adhesive layer.

Further detailed descriptions of the polymer resin layers, the insulating part 100, the adhesive layer 400, the cable 900, and the like may be omitted because they overlap with the above description.

The present disclosure will be described below in more detail with reference to specific embodiments. The following embodiments are provided for illustrative purposes only, and the scope of the present disclosure is not limited thereto.

1. PRODUCTION IN EMBODIMENTS AND COMPARATIVE EXAMPLES

1) Embodiments 1 and 2

A polyester resin was produced through copolymerization by transesterification of the following mole percents of diol-based compounds and dicarboxylic acid-based compounds with respect to all of the diol-based compounds and dicarboxylic acid-based compounds. An unstretched film was obtained by drying the polyester resin at 150° C. for 4 hours, melting and extruding the polyester resin through an extruder equipped with a screw at 280° C. to 300° C., and then adhering the polyester resin to a cooling roll cooled to 20° C. A stretched film was produced by immediately heating the unstretched film to 90° C. and stretching the unstretched film by factors of 3.0 and 3.6 in a longitudinal direction and in a transverse direction, respectively, at 110° C. to 140° C. A polymer resin layer with a thickness shown in Table 1 was produced by heat-setting the stretched film at a heat setting temperature shown in Table 1.

2) Comparative Examples 1 to 3

The production was made by applying compounds set forth in Table 1 in the same manner as that of the embodiments. However, the temperatures set forth in Table 1 were used as a heat setting temperature.

3) Comparative Examples 4 and 5

A poly(ethylene naphthalene 2,6-dicarboxylate) (PEN) resin and a polyimide (PI) resin were obtained from SKC, Inc. and SKCKolonPI, Inc., respectively and were processed as films with thicknesses set forth in Table 1. Then property evaluation was performed on the films.

TABLE 1

| | Composition of Resin | | | | Film process | | |
|---|---|---|---|---|---|---|---|
| | Diol-based compound [mol\%] | | Dicarboxylic acid-based compound [mol\%] | | Heat setting temperature | Thickness | |
| | EG* | CHDM* | TPA* | IPA* | (° C.) | (μm) | Remarks |
| Embodiment 1 | — | 100 | 95 | 5 | 240 | 25 | PET |
| Embodiment 2 | — | 100 | 80 | 20 | 240 | 25 | PET |
| Comparative Example 1 | 100 | — | 100 | — | 230 | 25 | PET |

TABLE 1-continued

| | Composition of Resin | | | | | | |
|---|---|---|---|---|---|---|---|
| | Diol-based compound [mol\%] | | Dicarboxylic acid-based compound [mol\%] | | Film process | | |
| | EG* | CHDM* | TPA* | IPA* | Heat setting temperature (° C.) | Thickness (μm) | Remarks |
| Comparative Example 2 | 70 | 30 | 100 | — | 120 | 25 | PETG |
| Comparative Example 3 | 40 | 60 | 100 | — | 120 | 25 | PCTG |
| Comparative Example 4 | | — | | | 240 | 25 | PEN |
| Comparative Example 5 | | — | | | — | 25 | PI |

*EG: Ethylene Glycol
CHDM: Cyclohexanedimethanol
TPA: Terephthalic Acid
IPA: Isophthalic Acid

2. PROPERTY MEASUREMENT METHOD

1) Glass Transition Temperature (Tg)

A glass transition temperature was measured by DSC Q2000 of TA Instruments, Inc.

2) Intrinsic Viscosity Retention Ratio

Through a pressure cooker test performed on an insulating part at 121° C. and 100 RH % for 96 hours, intrinsic viscosities were measured before and after the test, and intrinsic viscosity retention ratios were calculated using Equation 2 below:

$$D_{iv}=100\times(IV_2/IV_1), \quad \text{[Equation 2]}$$

where $D_{iv}$ is an intrinsic viscosity retention ratio, $IV_1$ is an intrinsic viscosity (dl/g) of the polymer resin layer before a pressure cooker test at 121° C. and 100 RH % for 96 hours, and $IV_2$ is an intrinsic viscosity (dl/g) of the polymer resin layer after the pressure cooker test.

3) Measurement of Shrinkage Ratios and Calculation of Product of Shrinkage Ratios The shrinkage ratios were obtained by evaluating a result of measuring the lateral length and longitudinal length of a sample of the insulating part, which has a lateral length of 20 cm and a longitudinal length of 1 cm, after the sample is heated in an oven at 150° C. for 30 minutes, as expressed in Equation 3, and then a product of the shrinkage ratios was calculated using Equation 1.

$$\text{Shrinkage Ratio (\%)}=[(L_0-L)/L_0]\times 100, \quad \text{[Equation 3]}$$

where $L_0$ is a longitudinal length or lateral length (cm) before the heat treatment and L is a longitudinal length or lateral length (cm) after the heat treatment.

$$C_{MD*TD}=C_{MD}\times C_{TD}, \quad \text{[Equation 1]}$$

where $C_{MD*TD}$ is a product of shrinkage ratios, $C_{MD}$ is a longitudinal shrinkage ratio (%), and $C_{TD}$ is a lateral shrinkage ratio (%).

3. PROPERTY MEASUREMENT RESULT

Properties of the embodiments and comparative examples evaluated according to the above property evaluation criteria are summarized in Table 2 below:

TABLE 2

| | Tg (° C.) | Shrinkage Ratio MD (%) | Shrinkage Ratio TD (%) | Product of Shrinkage Ratios MD * TD | Intrinsic Viscosity (IV) 0 hr | Intrinsic Viscosity (IV) 96 hr | IV Retention Ratio (%) |
|---|---|---|---|---|---|---|---|
| Embodiment 1 | 91.9 | 0.9 | 0.2 | 0.18 | 0.8 | 0.65 | 81 |
| Embodiment 2 | 88.4 | 1.0 | 0.2 | 0.2 | 0.79 | 0.63 | 80 |
| Comparative Example 1 | 78.2 | 1.5 | 0.2 | 0.3 | 0.71 | 0.23 | 32 |
| Comparative Example 2 | 83 | 5.0 or greater | 5.0 or greater | 25 or greater | 0.72 | 0.34 | 47 |
| Comparative Example 3 | 86.1 | 5.0 or greater | 5.0 or greater | 25 or greater | 0.72 | 0.5 | 69 |
| Comparative Example 4 | 123 | 0.6 | 0.4 | 0.24 | 0.69 | 0.38 | 55 |
| Comparative Example 5 | 360-410 | 0 | 0 | 0 | N/A | N/A | N/A |

Referring to Table 2, it could be seen that Embodiments 1 and 2 showed higher intrinsic viscosity retention ratios than Comparative Examples 1 to 4. Particularly, compared to Comparative Examples 1 and 2, Embodiments 1 and 2 showed high retention ratios by a factor of two or greater, and thus it was confirmed that the insulating layers of the embodiments had strong resistance to hydrolysis and excellent heat resistance and moisture resistance.

Also, Embodiments 1 and 2 showed superior characteristics in terms of shrinkage ratio. Both of a longitudinal shrinkage ratio and a transverse shrinkage ratio had relatively low values, and a product of the shrinkage ratios had the lowest value. This means that Embodiments 1 and 2 are excellent in heat resistance, and Embodiments 1 and 2 had much higher heat resistance compared to the comparative examples except polyimide.

Comparative example 6, in which a polyimide film was used, showed better results in terms of both of intrinsic viscosity retention ratio and shrinkage ratio than the embodiments, but has a limited use as an insulating layer of a cable due to fairly high product price.

Therefore, when being applied to an article such as a flexible flat cable, the insulating layer according to the embodiments of the disclosure can be used as a competitive insulating layer that improves physical properties such as heat resistance and moisture resistance, compared to conventional insulating layers, which have insufficient heat resistance and moisture resistance.

According to the examples described herein, the cable including the insulating part and the method of producing the cable insulating part can improve both heat resistance and moisture resistance and thus a material having a relatively low cost may be used as the insulating layer of the cable.

While specific examples have been shown and described above, it will be apparent after an understanding of the disclosure of this application that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. A cable comprising:

an insulating part; and one or more conducting parts disposed inside the insulating part, wherein the insulating part comprises a polymer resin layer with a product of shrinkage ratios $C_{MD*TD}$ of less than 0.24, as expressed in Equation 1 below:

[Equation 1]$C_{MD*TD}=C_{MD}\times C_{TD}$, where $C_{MD*TD}$ is a product of shrinkage ratios, $C_{MD}$ is a longitudinal shrinkage ratio (%), and $C_{TD}$ is a lateral shrinkage ratio (%), wherein a larger one of the longitudinal shrinkage ratio and the lateral shrinkage ratio of the polymer resin layer is less than or equal to 1.2%, wherein the insulating part comprises a polymer resin layer with an intrinsic viscosity retention ratio $D_{iv}$ of 70% or greater, as expressed in Equation 2 below:

[Equation 21]$D_{iv}=100\times(IV_2/IV_1)$, where $D_{iv}$ is an intrinsic viscosity retention ratio, $IV_1$ is an intrinsic viscosity (dl/g) of the polymer resin layer before a pressure cooker test at 121° C. and 100 RH % for 96 hours, and $IV_2$ is an intrinsic viscosity (dl/g) of the polymer resin layer after the pressure cooker test, wherein the insulating part is a polyester layer containing diol-based repeating units and dicarboxylic acid-based repeating units, wherein the dicarboxylic acid-based repeating units contains about 5 mol % to about 20 mol % isophthalic acid-based repeating units with respect to all the dicarboxylic acid-based repeating units, wherein the diol-based repeating units comprise a first diol-based repeating unit having a cyclohexane skeleton and a second diol-based repeating unit, wherein an amount of the first diol-based repeating unit is 85 mol % or greater with respect to all the diol-based repeating units, and wherein the second diol-based repeating unit is selected from the group consisting of spiroglycol, 1,3-propanediol, 1,2-octanediol, 1,3-octanediol, 2,3-butanediol, 1,3-butanediol, 1,5-pentanediol, 2,2-dimethyl-1,3-propanediol, 2-butyl-2-ethyl-1,3-propanediol, 2,2-diethyl-1,5-pentanediol, 2,4-diethyl-1,5-pentanediol, 3-methyl-1,5-pentanediol, 1,1-dimethyl-1,5-pentanediol, and combinations thereof.

2. The cable of claim 1, wherein a smaller one of the longitudinal shrinkage ratio and the lateral shrinkage ratio of the polymer resin layer is less than or equal to 0.3%.

3. The cable of claim 1, wherein the polymer resin layer has an intrinsic viscosity of 0.55 dl/g or greater after a pressure cooker test at 121° C. and 100 RH %, for 96 hours.

4. The cable of claim 1, wherein the cable is a flexible flat cable.

5. A cable comprising:

an insulating part; and one or more conducting parts disposed inside the insulating part, wherein the insulating part comprises a polymer resin layer with an intrinsic viscosity retention ratio $D_{iv}$ of 70% or greater, as expressed in Equation 2 below:

[Equation 2]

$D_{iv}=100\times(IV_2/IV_1)$, where $D_{iv}$ is an intrinsic viscosity retention ratio, $IV_1$ is an intrinsic viscosity (dl/g) of the polymer resin layer before a pressure cooker test at 121° C. and 100 RH % for 96 hours, and $IV_2$ is an intrinsic viscosity (dl/g) of the polymer resin layer after the pressure cooker test, wherein a larger one of a longitudinal shrinkage ratio and a lateral shrinkage ratio of the polymer resin layer is less than or equal to 1.2%, wherein the insulating part is a polyester layer containing diol-based repeating units and dicarboxylic acid-based repeating units, wherein the dicarboxylic acid-based repeating units contains about 5 mol % to about 20 mol % isophthalic acid-based repeating units with respect to all the dicarboxylic acid-based repeating units, wherein the diol-based repeating units comprise a first diol-based repeating unit having a cyclohexane skeleton and a second diol-based repeating unit, wherein an amount of the first diol-based repeating unit is 85 mol % or greater with respect to all the diol-based repeating units, and wherein the second diol-based repeating unit is selected from the group consisting of spiroglycol, 1,3-propanediol, 1,2-octanediol, 1,3-octanediol, 2,3-butanediol, 1,3-butanediol, 1,5-pentanediol, 2,2-dimethyl-1,3-propanediol, 2-butyl-2-ethyl-1,3-propanediol, 2,2-diethyl-1,5-pentanediol, 2,4-diethyl-1,5-pentanediol, 3-methyl-1,5-pentanediol, 1,1-dimethyl-1,5- pentanediol, and combinations thereof.

6. The cable of claim 5, wherein a smaller one of a longitudinal shrinkage ratio and a lateral shrinkage ratio of the polymer resin layer is less than or equal to 0.3%.

7. The cable of claim 5, wherein the polymer resin layer comprises an intrinsic viscosity of 0.55 dl/g or greater after the pressure cooker test.

8. The cable of claim 5, wherein the cable is a flexible flat cable.

9. The cable of claim 5, wherein the polymer resin layer comprises an intrinsic viscosity retention ratio $D_{iv}$ of about 75% to about 85%.

* * * * *